United States Patent [19]

Brown

[11] 4,401,026

[45] Aug. 30, 1983

[54] FREE FLIGHT HAMMER FOR IMPACT PRINTER

[75] Inventor: W. Sumner Brown, Cambridge, Mass.

[73] Assignee: Exxon Reserach and Engineering Co., Florham Park, N.J.

[21] Appl. No.: 340,213

[22] Filed: Jan. 18, 1982

Related U.S. Application Data

[63] Continuation of Ser. No. 166,200, Jul. 7, 1980, abandoned, which is a continuation of Ser. No. 56,986, Jul. 12, 1979, abandoned, which is a continuation of Ser. No. 833,267, Sep. 14, 1977, abandoned.

[51] Int. Cl.[3] ..... B41J 9/30

[52] U.S. Cl. ..... 101/93.33; 101/93.48

[58] Field of Search ..... 101/93.02, 93.05, 93.29, 101/93.34, 93.48; 400/144.2, 144.3

[56] References Cited

U.S. PATENT DOCUMENTS

| | | | |
|---|---|---|---|
| 3,473,466 | 10/1969 | Thayer | 101/93.48 |
| 3,543,906 | 12/1970 | Hladky | 101/93.29 X |
| 3,707,122 | 12/1972 | Cargill | 101/93.34 |
| 3,901,371 | 8/1975 | Scott | 400/144.2 |
| 4,004,505 | 1/1977 | Magnenet | 101/93.48 |
| 4,018,155 | 4/1977 | Corgill | 101/93.33 |
| 4,037,532 | 7/1977 | Plaza et al. | 101/93.48 |
| 4,070,903 | 1/1978 | Weaver | 101/93.29 |

OTHER PUBLICATIONS

Mills et al, IBM Tech. Discl. Bulletin, vol. 15, No. 8, 1/73, p. 2356.

*Primary Examiner*—Edward M. Coven

[57] ABSTRACT

The hammer of a serial impact printer comprises a solenoid including a stationary magnetic structure with an opening extending therethrough and a movable magnetic structure adapted to move through the opening. The movable magnetic structure is accelerated by the flux path from the stationary magnetic structure and through the movable magnetic structure as the gap between the movable and stationary magnetic structures closes such that the movable magnetic structure is in substantially unobstructed free flight before the impact area coupled to the movable magnetic structure strikes the character element. The character element in turn strikes a print receiving medium supported by a platen, typically through an ink-bearing ribbon.

6 Claims, 5 Drawing Figures

FREE FLIGHT HAMMER FOR IMPACT PRINTER

This is a continuation, of application Ser. No. 166,200, filed July 7, 1980, abandoned which is a continuation of Ser. No. 056,986, filed July 12, 1979, abandoned which was a continuation of Ser. No. 833,267, filed Sept. 14, 1977, abandoned.

BACKGROUND OF THE INVENTION

This invention relates to impact printers, and more particularly, to a hammer which strikes a character element so as to cause the character element to impact a print receiving medium juxtaposed to a support surface.

Heretofore, solenoids have been utilized to actuate the hammers of impact printers so as to move the impact area of the hammer toward the character element. A prior art hammer is depicted in FIG. 1 wherein a movable magnetic structure or plunger 12 is mounted within an axially extending opening 14 of a stationary magnetic structure 10. When an annular winding or coil 16 associated with the stationary magnetic structure 10 is energized, an axially extending flux path 18 is created which forces the movable magnetic structure 12 against a ferromagnetic stop 20 which obstructs one end of the opening 14. The movable magnetic structure 12 is coupled to an elongated member 22 which extends from one end of the movable magnetic structure 12 through a central opening 21 in the obstruction 20 so as to allow the elongated member 22 having an impact area 26 at the end thereof to strike a character element 28 juxtaposed to a support surface in the form of a platen 30.

Typically, the prior art hammer of FIG. 1 is designed such that the impact area 26 will strike the character element 28 when the movable magnetic structure 12 is very close to the obstruction 20 at the end of the opening 14. At this moment in time, the movable magnetic structure 12 has the maximum force applied thereto and neither the movable magnetic structure 12 nor the impact area 26 at the end of the elongated member 22 is in free flight at a substantially constant velocity for the case of the hammer striking with its maximum force. To the contrary, for this case, the impact area 26 coupled to the movable magnetic structure 12 is accelerating to an ever-increasing velocity until such time as the impact area 26 strikes the character element 28.

It will therefore be understood that the prior art hammer does not reach the maximum impact velocity prior to the time that the impact area strikes the character element. Rather, the hammer is in the process of accelerating to that velocity at the time the hammer strikes. As a consequence, the prior art hammers have a longer cycling time which means that the printing speed is not at the optimum. Moreover, the prior art hammer will not achieve the maximum speed possible from the magnetic structure unless the impact area is properly positioned with respect to the obstruction 20 to assure that the impact area 26 strikes the character element 28 at the exact same moment that the movable magnetic structure 12 strikes the obstruction 20.

SUMMARY OF THE INVENTION

It is an object of this invention to provide a hammer for an impact printer wherein the hammer is in free flight prior to striking a character element.

It is also an object of this invention to provide a hammer for an impact printer which reaches the maximum hammer speed quickly.

It is a further object of this invention to minimize the cycling time for the hammer.

It is also an object of this invention to provide a hammer which will not obstruct the operator's view of the characters just printed.

It is a still further object of this invention to provide a hammer which is generally axially symmetric so as to minimize manufacturing costs.

In accordance with these objects of the invention, a preferred embodiment of the invention comprises a support surface adapte to support a medium for receiving print, a character element juxtaposed to the surface and adapted to be forced into contact with the print receiving medium, usually through a ribbon, and an improved hammer including an impact area for striking the character element and forcing the character element against the print receiving medium supported by the support surface.

The improved hammer comprises a stationary magnetic structure comprising a high permeability material where the stationary magnetic structure has an opening therethrough with magnetic material on opposite sides of the opening. A movable magnetic structure coupled to the impact area is adapted to move substantially axially through the opening so as to close an air gap. The movable magnetic structure closes the gap before the impact area strikes the character element. After the gap is closed, the movable magnetic structure is in substantially free flight.

In the preferred embodiment of the invention, the stationary magnetic structure is substantially annular and forms a central opening extending therethrough. The movable magnetic structure may have a slot extending parallel to the direction of linear movement for reducing eddy currents in the movable magnetic structure. Where the opening is circular in cross-section and the impact area is elongated or non-circular, it may be desirable to utilize a projection extending from the stationary magnetic structure into the slot so as to prevent rotational motion of the movable magnetic structure in the slot and thereby maintain the proper orientation of the elongated or non-circular impact area.

The hammer means has a rigid elongated movable non-magnetic member attached to the movable magnetic structure and extending to the impact area. A coiled detent spring may encircle the rigid elongated non-magnetic member and contact the movable magnetic structure for maintaining the impact area away from the character element after striking the character element and the support surface and bouncing away therefrom.

DETAILED DESCRIPTION OF A PREFERRED EMBODIMENT

Figure 1:
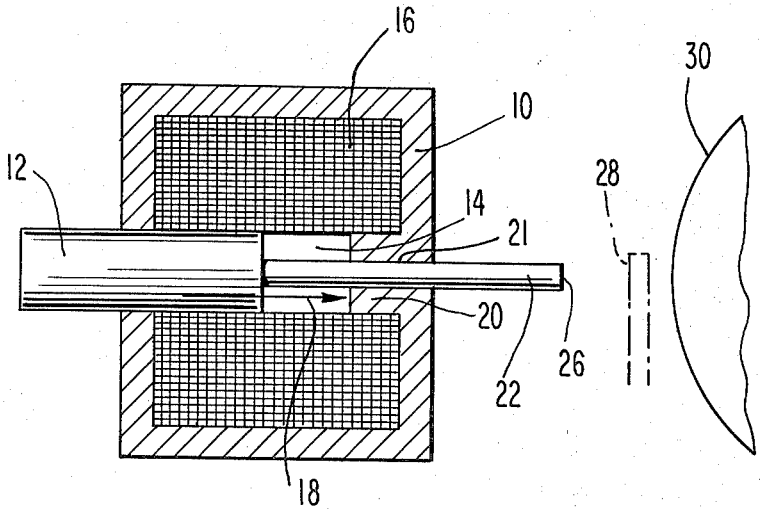
PRIOR ART Fig. 1
FIG. 1 is a sectional, partially schematic view of the prior art hammer discussed in the foregoing.
Figure 2:
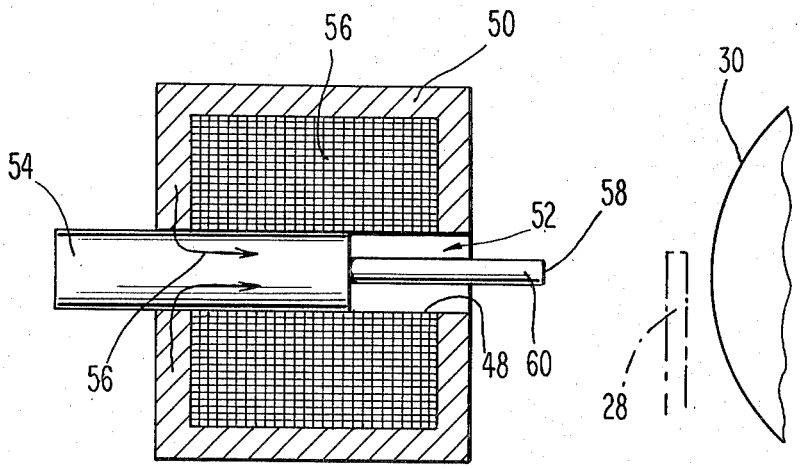
FIG. 2 is a cross-sectional, partially schematic view of a preferred embodiment of the invention.

Referring now to FIG. 2, the preferred embodiment of the invention comprises a solenoid hammer including a stationary magnetic structure 50 comprising a high permeability material and having an axially extending opening 48 extending therethrough and a movable magnetic structure or plunger 54 comprising a high permeability material and adapted to move rectilinearly through the axially extending opening 48 so as to close an air gap 52. Windings 56 encircle the movable magnetic structure 54 so as to create a magnetic flux 57 through the stationary magnetic structure and the movable magnetic structure 54. Magnetic forces associated with the magnetic flux in the air gap 52 move the movable magnetic structure forward toward a support surface or platen 30 with an interposed character element 28. An impact area 58 is located at the end of a rigid non-magnetic elongated member 60 which is connected to the movable magnetic structure 54.

In accordance with this invention, the opening 48 is unobstructed so that the movable magnetic structure will enter the opening 48 substantially before impacting or striking the character element 28 by the impact area 58. Accordingly, the movable magnetic structure 54 and the impact area 58 are in free flight at the time of striking the character element 28.

Figure 3:
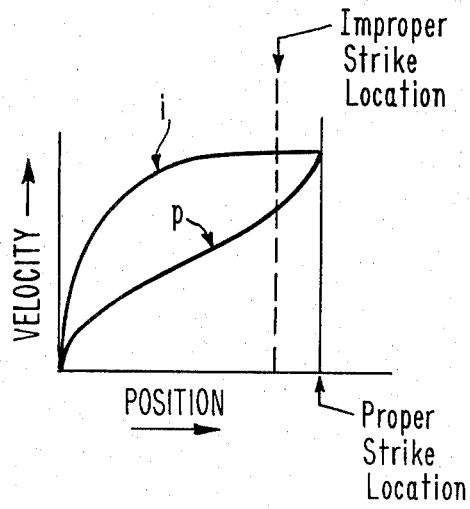
FIG. 3 is a graph illustrating the performance characteristics of a hammer embodying the invention as contrasted with the hammer of the prior art.

Reference will now be made to FIG. 3 for a discussion of the advantages of the invention over the prior art. As stated earlier, it is an objective of this invention to achieve the impact hammer speed quickly so as to minimize cycling time. In the graph shown in FIG. 3, velocity is indicated on the ordinate and position is indicated on the abscissa with the strike position shown. It will be understood that FIG. 3 represents the case of hammers striking with their maximum strength, as for example when striking a character with relatively large area and making many carbon copies. It will be noted that the curve i representing the velocity versus position of the hammer of this invention clearly shows that the impact velocity is reached by the hammer very quickly and the hammer moves at a substantially constant velocity to the strike position. In other words, the hammer is in free flight well prior to reaching the strike position. On the other hand, the curve p representing the prior art velocity versus position illustrates that the velocity of the hammer is still increasing at the time the hammer reaches the strike position. Accordingly, the cycling time of the prior art hammer is substantially longer. Moreover, it is clear that the prior art hammer is not in free flight at the time of the strike. Rather, force is still being applied to the hammer at the moment the hammer reaches the strike position.

The dotted line represents the striking position when the hammer is improperly located with respect to the platen 30. In the case of the prior art, the hammer reaches the strike position before the hammer has reached its maximum velocity, i.e., the movable magnetic structure 12 of the prior art hammer never reaches the obstruction 20 at the time of striking the character element 28. In the case of this invention, the striking velocity error due to the improper location is negligible.

Figure 4:
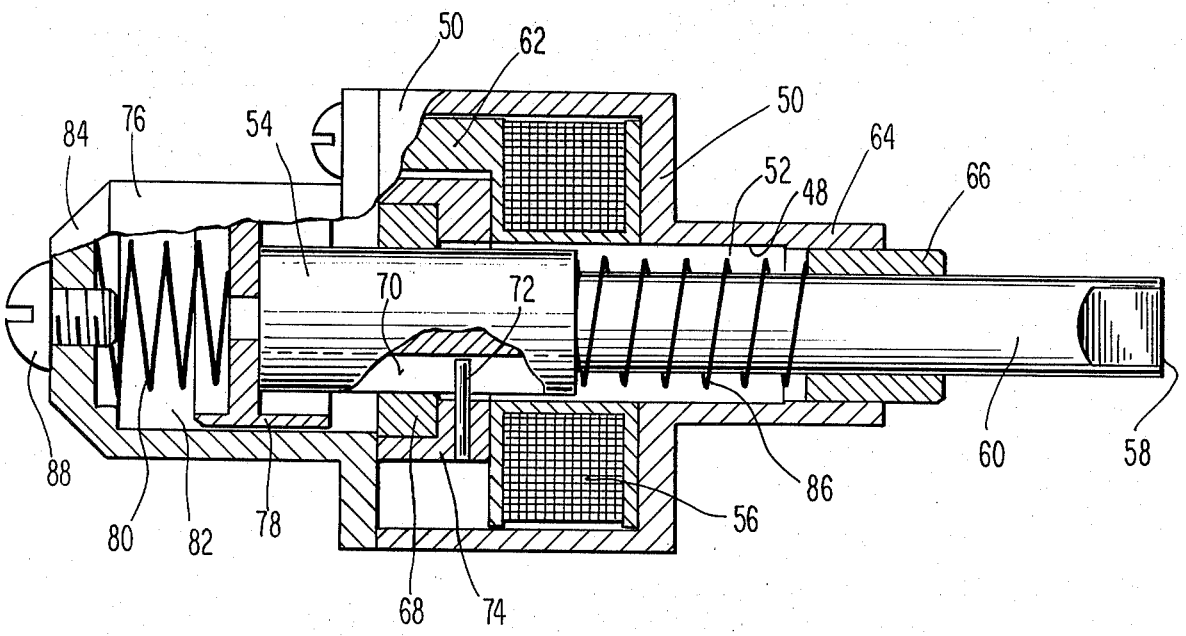
FIG. 4 is a detailed sectional view of a hammer constructed in accordance with the principles of this invention representing the preferred embodiment thereof.
Figure 5:
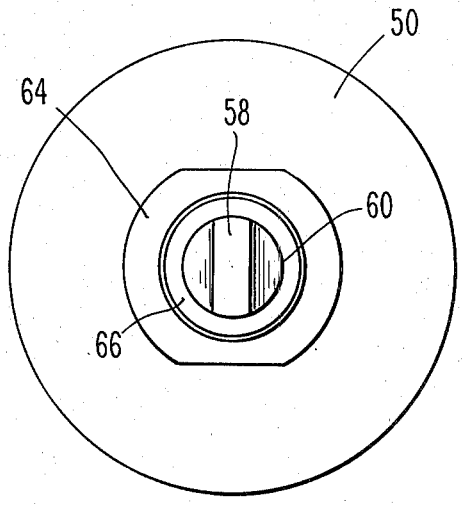
FIG. 5 is an end view of the hammer shown in FIG. 3.

Reference will now be made to FIGS. 4 and 5 for a detailed description of the preferred embodiment of the invention wherein low cost is achieved. As shown in FIG. 4, the windings 56 are formed on a bobbin 62 comprising a non-magnetic material. The stationary magnetic structure 50 forms a housing for the hammer and encloses the windings 56. The stationary magnetic structure 50 includes a sleeve 64 which extends forward toward the impact area 58. A sleeve-like bearing 66 is enclosed within the sleeve 64 to support the elongated member 60. An additional non-magnetic bearing surface 68 guides the rear of the movable magnetic structure 54.

As shown in FIG. 5, the elongated member 60 is circular in cross-section whereas the impact area 58 is elongated. Similarly, the movable magnetic structure 54 is circular in cross-section.

The movable magnetic structure 54 includes a slot 70 extending parallel with the axis of the hammer. The slot 70 acts to reduce eddy currents in the movable magnetic structure 54. In addition, a pin 72 forms a projection into the slot 70 from the magnetic bearing material 74 (or from the bearing surface 68) so as to maintain the proper orientation for the elongated impact area 58.

A dash pot 76 is associated with the rear of the hammer. The dash pot includes a piston 78 and a spring 80. As the movable structure 54 and the elongated member 60 is driven rearwardly after bouncing off the platen, air trapped in the area 82 between the piston 78 and the housing 84 escapes around the piston 78 toward the non-magnetic bearing material 68 and past the screw 88 to cushion the return of the movable magnetic structure 54. In order to hold the impact area 58 in the retracted position, a detent coil spring 86 is provided between the sleeve-like bearing material 66 and the movable magnetic structure 54. The spring 86 provides insufficient resistance when the hammer is energized to substantially affect the free flight of the structure 54. A screw 88 controls the leakage of air which cushions the return of the structure 54 and the elongated member 60.

Although the printer in which the hammer of this invention has not been described in detail, it will be understood that various types of impact printers might utilize the hammer. For example, the serial impact printer described in copending application Ser. No. 833,271 filed Sept. 14, 1977 now U.S. Pat. No. 4,149,808 and application Ser. No. 809,923 filed June 24, 1977 now abandoned, which are assigned to the assignee of this invention and incorporated herein by reference, are appropriate serial impact printers for use of the hammer.

Although a particular embodiment of the invention has been shown and described in detail, it will be understood that various modifications will occur to those of ordinary skill in the art which fall within the true spirit and scope of the invention as set forth in the appended claims.

What is claimed is:

1. Impact printing apparatus comprising:

a medium for receiving print;

a character element juxtaposed to said medium and adapted to contact with said print receiving medium; and hammer means including an impact area movable between a rest position and an impact position thereby causing contact between said character element and said print receiving medium, the improvement residing in said hammer means comprising:

a stationary magnetic structure comprising a high permeability material and electrically energizable windings, said stationary magnetic structure having an opening therein with said material on opposite sides thereof so as to form an axially extending unobstructed magnetic air gap;

a movable magnetic structure rigidly coupled to said impact area, said movable magnetic structure comprising a high permeability material adapted to move substantially axially through said opening from a first position partially closing said magnetic air gap to a second position in a direction toward said character element substantially closing said magnetic air gap upon energization of said windings, the distance between said first and said second positions being less than the distance between said rest and said impact positions, the length of said movable magnetic structure being greater than the length of said axial air gap and greater than the distance between said rest and said impact positions, said movable magnetic structure being free for axial movement through said gap such that said movable magnetic structure substantially closes said air gap before and until said impact area causes a character element to contact said medium and said movable magnetic structure is in substantially free flight at a substantially constant velocity when said contact occurs; and a detent spring contacting said movable magnetic structure for maintaining said impact area away from said character element except when said windings are energized, said spring providing insufficient resistance to substantially affect the free flight of said movable magnetic structure.

2. The impact printing apparatus of claim 1 wherein said movable magnetic structure has a slot extending parallel to the direction of linear movement for reducing eddy currents in said movable magnetic structure.

3. The impact printing apparatus of claim 2 wherein said opening is circular in cross-section.

4. The impact printing apparatus of claim 3 further comprising a substantially stationary projection extending inwardly into said slot so as to prevent rotational motion of said movable magnetic structure in said gap.

5. The impact printing apparatus of claim 4 wherein said stationary magnetic structure is substantially annular.

6. The impact printing apparatus of claim 1 wherein said hammer means comprises a rigid elongated nonmagnetic member extending from said movable magnetic structure to said impact area.

* * * * *